US005816690A

United States Patent [19]

Romano et al.

[11] Patent Number: 5,816,690

[45] Date of Patent: Oct. 6, 1998

[54] COMPACT THEATRICAL LIGHT AND METHOD

[75] Inventors: Richard J. Romano, Corona; Robert A. Fry, Tustin, both of Calif.

[73] Assignee: The Obie Company, Torrance, Calif.

[21] Appl. No.: 547,017

[22] Filed: Oct. 23, 1995

Related U.S. Application Data

[63] Continuation-in-part of Ser. No. 350,094, Nov. 29, 1994, Pat. No. 5,626,416, which is a continuation-in-part of Ser. No. 383,892, Feb. 6, 1995, abandoned.

[51] Int. Cl.[6] ..... F21V 13/06

[52] U.S. Cl. ..... 362/281; 362/268; 362/299; 362/301; 362/319; 362/293

[58] Field of Search ..... 362/297, 346, 362/268, 281, 319, 293, 294, 299, 301; 353/101; 359/385, 686, 660, 676

[56] References Cited

U.S. PATENT DOCUMENTS

| | | | |
|---|---|---|---|
| 3,920,315 | 11/1975 | Linke | 359/686 |
| 4,890,208 | 12/1989 | Izenour | 362/281 |
| 4,914,556 | 4/1990 | Richardson | 362/293 |
| 5,143,444 | 9/1992 | Shields | 362/293 |
| 5,207,505 | 5/1993 | Naraki et al. | 362/294 |
| 5,463,497 | 10/1995 | Muraki et al. | 362/268 |
| 5,590,955 | 1/1997 | Bornhorst et al. | 362/284 |

*Primary Examiner*—Alan Cariaso
*Attorney, Agent, or Firm*—Jones, Day, Reavis & Pogue

[57] ABSTRACT

A compact and efficient theatrical light that includes four mirrors, a gobo apparatus a colorchanger/dowser/diffusion system, and a lens system. The light beam is reflected four times, each time by 90 degrees. The second reflection is perpendicular to the plane formed by the initial path of the beam and the path after the first reflection. The gobo, the lens system and the colorchanger/dowser/diffusion system are located between the second and the third mirrors. This achieves a very compact, but fully capable light which may be attached to and protected by a truss system when in use and when in transport.

Also discussed is a simple color changer/dowser/diffusion system with color glass panels mounted to tracks and moveable into and out of the optical path by cables connected to each panel.

16 Claims, 6 Drawing Sheets

COMPACT THEATRICAL LIGHT AND METHOD

CROSS-REFERENCE TO RELATED APPLICATIONS

This application is a continuation-in-part of application, Ser. No. 08/350,094, filed on Nov. 29, 1994 and of application, Ser. No. 08/383,892, filed on February 1995, which are commonly assigned with the present invention.

BACKGROUND OF THE INVENTION

1. Field of the Invention

The present invention relates to a light and more particularly to a theatrical light which is compact and efficient and especially designed to operate with a compact truss.

2. Description of the Related Art

Theatrical lights are often attached to trusses which are suspended above a stage. New trusses have been built to be erected and transported quickly with minimal labor. One way to increase efficiency of the assembly and disassembly of stage lighting is to mount lights to the truss and have them remain with the truss even when the trusses and lights are transported to a new venue. However, this would require the light to be compact and yet provide the same performance as existing lights.

There are many existing theatrical lighting devices on the market today. Nevertheless, there is a continuing need for a lights with greater brightness, lower weight, reduced size, greater efficiency, increased reliability and enhanced ease of operation.

Prior attempts to provide a superior theatrical light have yet to produce an optimal system though many competitors have tried to do so.

BRIEF SUMMARY OF THE INVENTION

The difficulties encountered by previous theatrical lights have been overcome by the present invention. What is here described is a compact theatrical light comprising a housing, a light source mounted in the housing for initiating a light beam, a first mirror mounted in the housing for receiving the light beam from the light source and for altering the direction of the beam by approximately 90 degrees, a second mirror mounted in the housing for receiving the light beam from the first mirror and for altering the direction of the beam by approximately 90 degrees, a third mirror mounted in the housing for receiving the light beam from the second mirror and for again altering the direction of the beam by approximately 90 degrees, and a fourth mirror mounted in the housing for receiving the light beam from the third mirror and for altering the direction of the beam by approximately 90 degrees.

The invention also includes a method for forming a compact theatrical light comprising the steps of forming an optical path, altering the optical path by about 90 degrees relative to its first disposition, altering the optical path by about 90 degrees again from a plane formed by the first disposition of the optical path and the disposition of the optical path after its first alteration, placing a gobo in the optical path after its first alteration, placing a color changer in the optical path after its second alteration, and placing a lens in the optical path after its second alteration.

An object of the present invention is to provide a theatrical light which is compact. Another aim of the present invention is provided a light which fits within and is supported by a compact truss. A further aspect of the present invention is to provide a theatrical light which is efficient, reliable and robust.

A more complete understanding of the present invention and other objects, aspects, aims and advantages thereof will be gained from a consideration of the following description of the preferred embodiment read in conjunction with the accompanying; drawings provided herein.

DETAILED DESCRIPTION AND SPECIFICATION OF THE INVENTION

Figure 1:
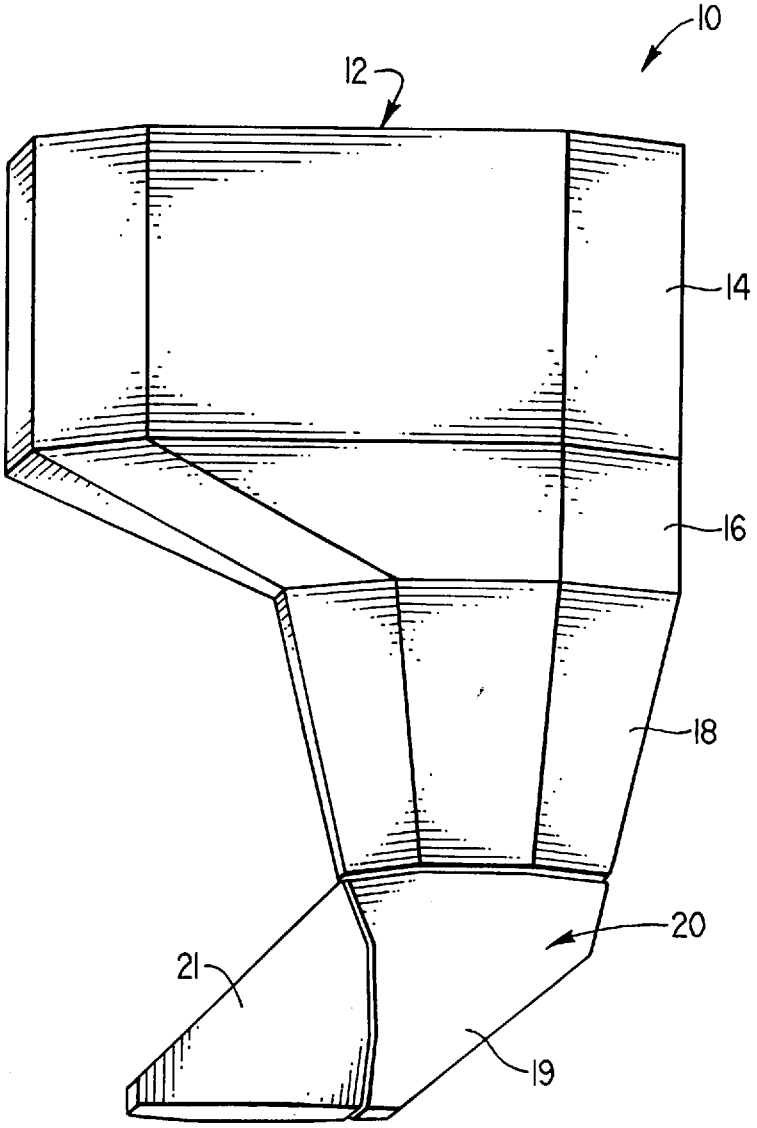
FIG. 1 is a diagrammatic perspective view of the compact light of the present invention.

While the present invention is open to various modifications and alternative constructions, the preferred embodiments shown in the drawings will be described herein in detail. It is to be understood, however, that there is no intention to limit the invention to the particular forms disclosed. On the contrary, the intention is to cover all modifications, equivalences, and alternative constructions falling within the spirit and scope of the invention as expressed in the appended claims.

Referring now to FIG. 1, there is illustrated a compact theatrical light 10. The light includes an outer housing 12, having a base section 14, a transitional section 16, a projecting section 18 and a turret section 20. The base is in the shape of a right octagonal prism. The transitional section 16 is in the shape of an oblique octagonal prism. The projecting section 18 has a right octagonal truncated pyramid shape. The turret 20 has a first part 19 rotatably connected to the projecting section and a second part 21 which is rotatably connected to the first part. In the FIG. 1 view, the first part 19 rotates about a vertical axis, and the second part rotates about a horizontal axis. This arrangement of the turret allows for a very large area to be covered by the light.

Figure 2:
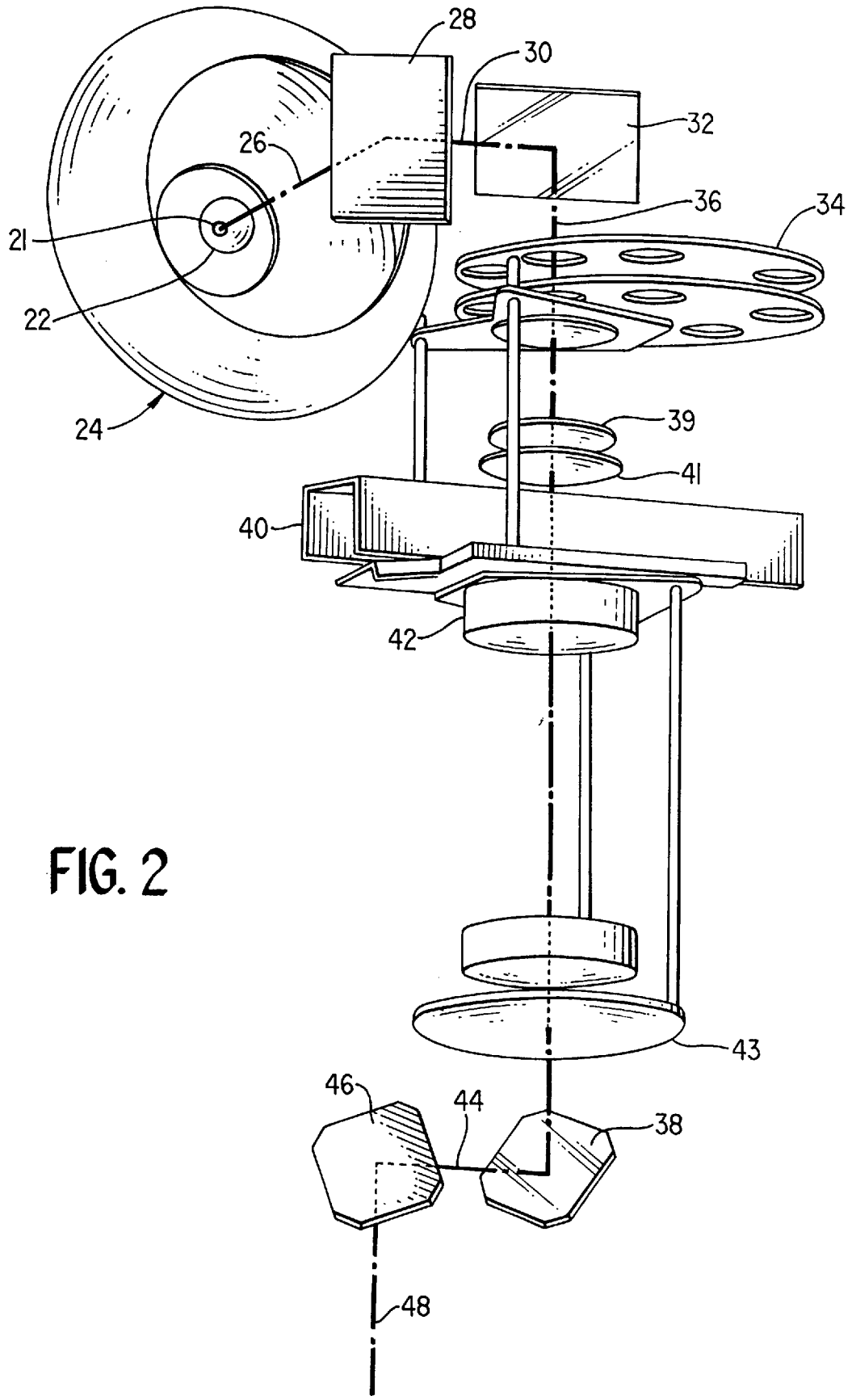
FIG. 2 is an enlarged diagrammatic, perspective view of the elements used to create the optical path of the present invention.

Referring now to FIG. 2, the internal elements of the compact light is illustrated in diagrammatic form. Light is generated by a lamp 22, having a reference center point 21 and surrounded by efficient reflectors 24. As explained in co-pending application, Ser. No. 08/350,094, the lamp 22 is a 2000 watt xenon lamp which is surrounded by an elliptical reflector 23, FIG. 5, of cold mirror dichroic and a spherical reflector 25 also of cold mirror dichroic. These initiate a light beam represented by the phantom line 26. The light beam is reflected by a first mirror 28, about fourteen inches away, through approximately 90 degrees causing the beam to move laterally, as depicted by the phantom line 30. The light beam is again reflected or altered by a second mirror 32 located about 2.5 inches away from the first mirror.

The second mirror 32 also reflects the light beam approximately 90 degrees, as depicted by a phantom line 36. The light beam continues until it is reflected from a third mirror 38 about 23 inches away from the second mirror. Positioned to affect the beam between the mirrors 32 and 38 is a gobo apparatus 34, a color changer/dowser/diffusion system 40, and several lenses 39, 41, 42 and 43.

The lens 39 is a moveable focus lens and has a travel of about 2.5 inches between the fixed lens 41 and the gobo 34. The lens 42 is a zoom lens moveable about 7.75 inches to provide approximately a 5 to 1 zoom ratio. The zoom lens comes to within about 3.25 inches of the fixed lens 41 and 2 inches of the fixed output lens 43. The distance between the focus lens when it is nearest the second mirror 36, and the output lens is about 15.5 inches. The light beam exiting the lens 43 is reflected approximately 90 degrees by the third mirror 38 as depicted by the phantom line 44. The beam is altered for the fourth time when it is reflected by approximately 90 degrees by a fourth mirror 46 as depicted by the phantom line 48.

The third mirror 38 is a "pan" mirror which is rotatable through 360 degrees by being mounted in the first part 19 of the turret 20. In a like manner, the fourth mirror 46 is a "tilt" mirror which is also rotatable through 360 degrees by being mounted in the second part 21 of the turret 20. The five phantom lines 26, 30, 36, 44 and 48 define the optical path for the light of the present invention.

Figure 3:
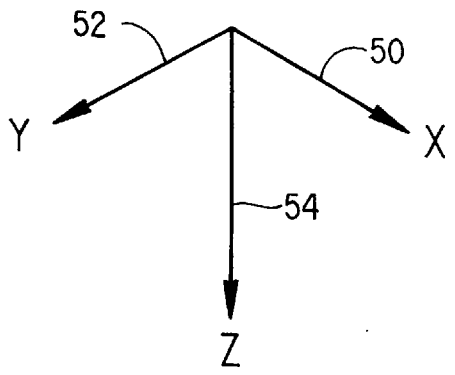
FIG. 3 is a perspective view of three mutually perpendicular axes for reference purposes.

Referring to FIG. 3, as an aid in understanding the directions of the optical path, a three-dimensional axes system is depicted. This includes an X-axis 50, a Y-axis 52 and a Z-axis 54. The X-axis is perpendicular to the Y-axis, and to the Z-axis. In a like fashion, the Y-axis is also perpendicular to the Z-axis. Furthermore, the Z-axis is perpendicular to the plane formed by the X and Y-axes. With that explanation, and referring back to FIG. 2, the optical path may now be better understood by visualizing that the optical path represented by the line 26 is parallel to the X-axis 50. That portion of the optical path represented by the line 30 is parallel to the Y-axis 52. The portion of the optical axis represented by the line 36 is parallel to the Z-axis 54. Thus, the line 26 is perpendicular to the line 30, the line 30 is perpendicular to the line 36 and the line 36 is perpendicular to an imaginary plane formed by the lines 26 and 30.

By reflecting the light beam in the manner described, the advantages of a compact, but powerful and efficient light are achieved. This arrangement also allows the lamp 22 to remain in a fixed orientation, thus prolonging its useful life.

Figure 4:
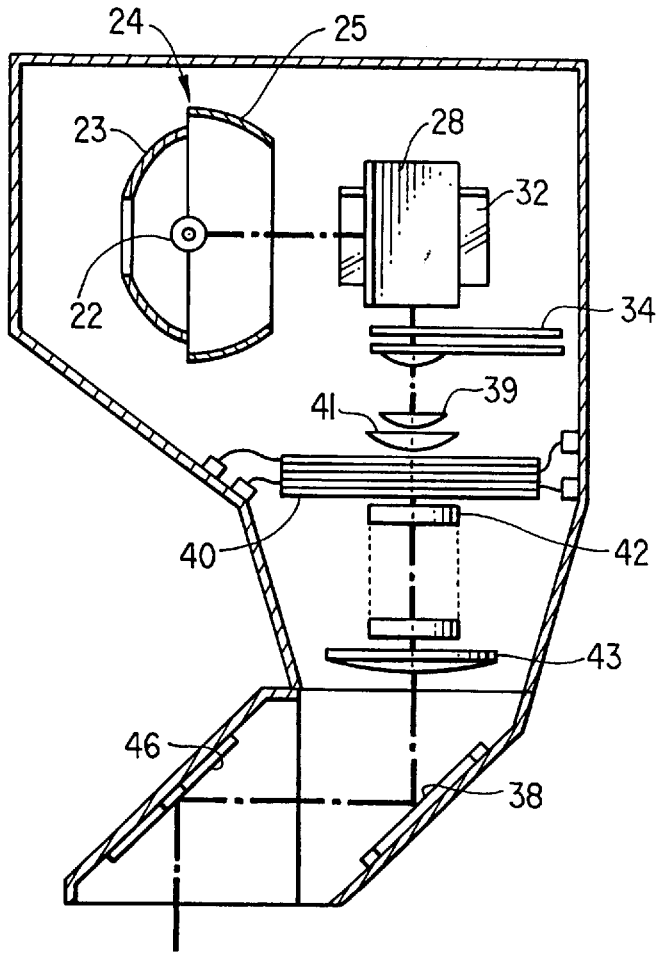
FIG. 4 is a diagrammatic front elevational view of the theatrical light of the present invention illustrating selected internal elements.
Figure 5:
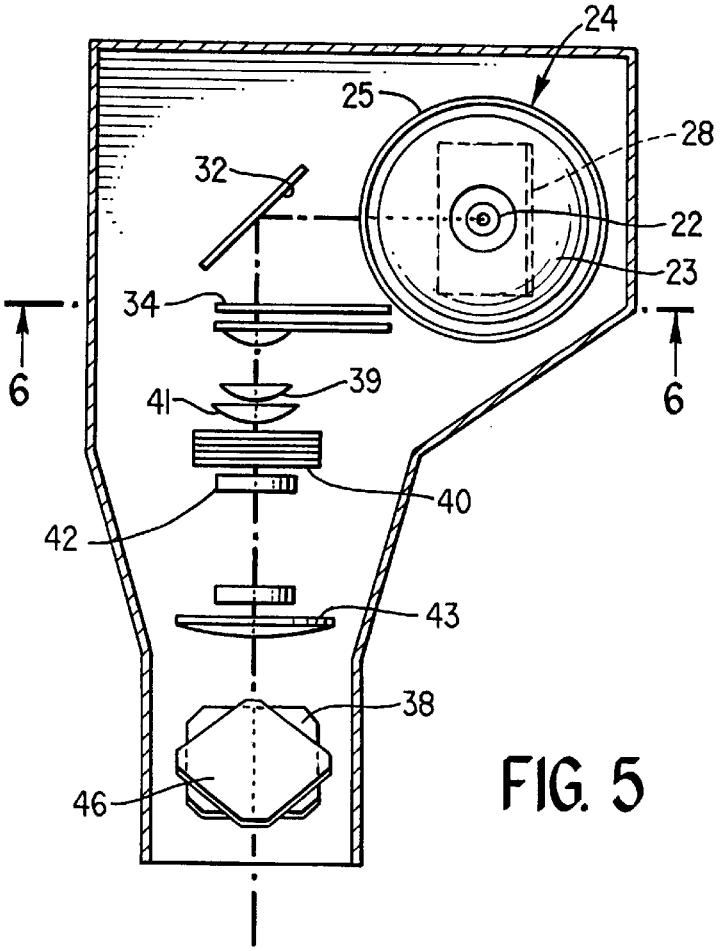
FIG. 5 is a diagrammatic side elevational view of the light of the present invention illustrating the same selected internal elements shown in FIG. 4.
Figure 6:
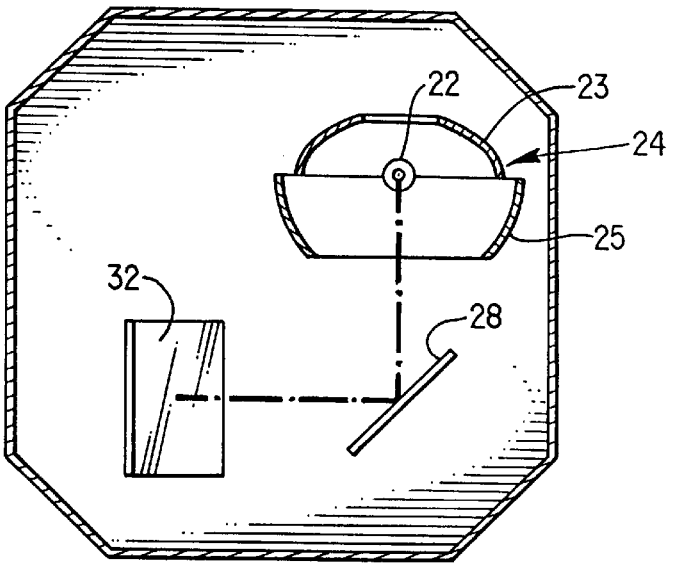
FIG. 6 is a diagrammatic bottom plan view taken along line 6—6 in FIG. 5.

Referring now to FIGS. 4, 5 and 6, the relative locations of the different elements inside the housing are depicted. For example, the light source 22, the reflectors 23, 25, the first mirror 28, and the second mirror 32 are primarily located in the housing's base section 14. The gobo apparatus 34, the color/dowser/diffusion system 40, the lenses 39, 41 and 43 are located in the transitional and projecting sections. The pan and tilt mirrors 38, 46 are located in the turret 20, the pan mirror in the first part 19 and the tilt mirror in the second part 21.

Figure 7:
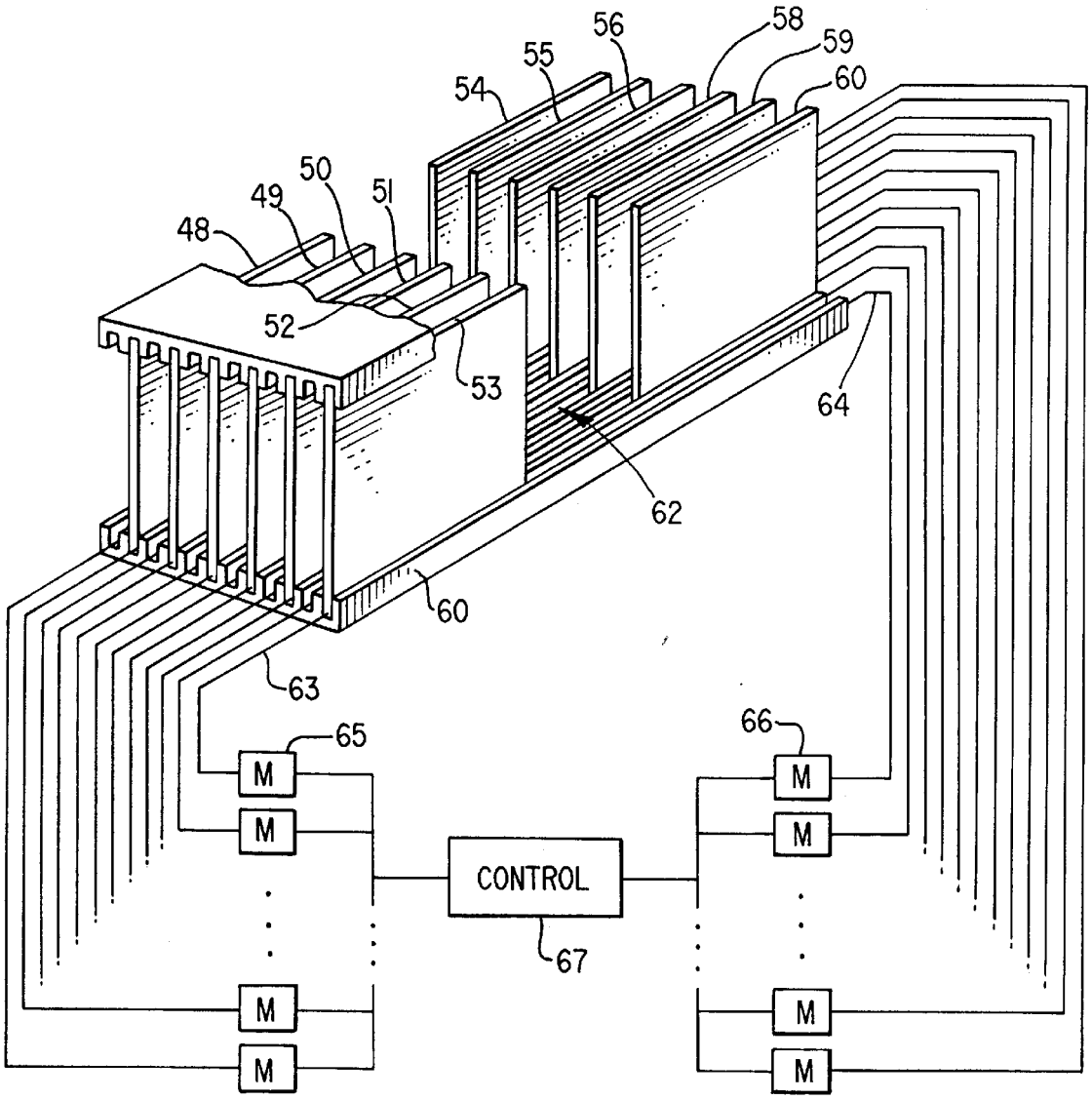
FIG. 7 is an enlarged perspective view of the color/dowser/diffusion system of the present invention.

Referring now to FIG. 7, there is illustrated the color/downer/diffusion system in more detail. Twelve color glass panels 48, 49, 50, 51, 52, 53, 54, 55, 56, 57, 58, 59 are mounted within track frames 60 and 61 in two groups, six panels to one side and six panels to the other side. The track frame 61 is broken away to more clearly show the glass panels. Between the two groups of panels is an open space, graphically identified by the number 62 and corresponding lead line. The optical path, represented by the phantom line 36 in FIG. 2, passes through the open space 62. The glass panels, either individually or in any combination, may be moved into the optical path, depending upon the lighting effect desired.

Each panel is connected to a flexible cable at one end and another flexible cable at its other end, such as the cable 63 connected to one end of the panel 51 and the cable 64 connected to its other end. Each cable is connected to a respective motor which is mounted to the housing. For example, the cable 63 is connected to a motor 65 and the cable 64 is connected to a motor 66. In a like manner each panel is connected to two cables and each cable is connected to a motor. The motors are connected to a control system represented by the rectangle 67.

Figure 8:
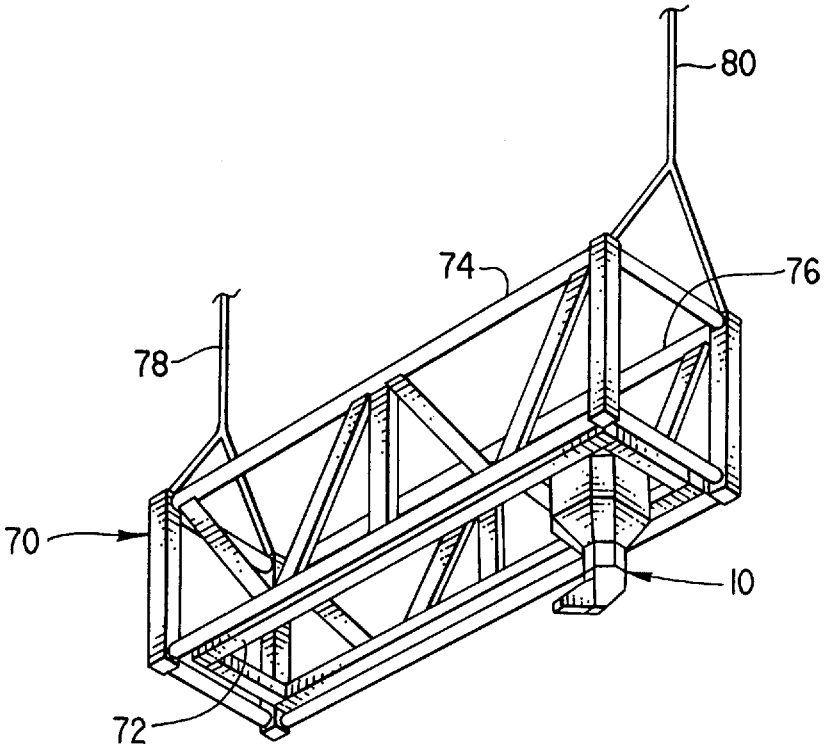
FIG. 8 is a diagrammatic perspective view of the theatrical light of the present invention mounted to a compact truss and shown in a suspended mode.
Figure 9:
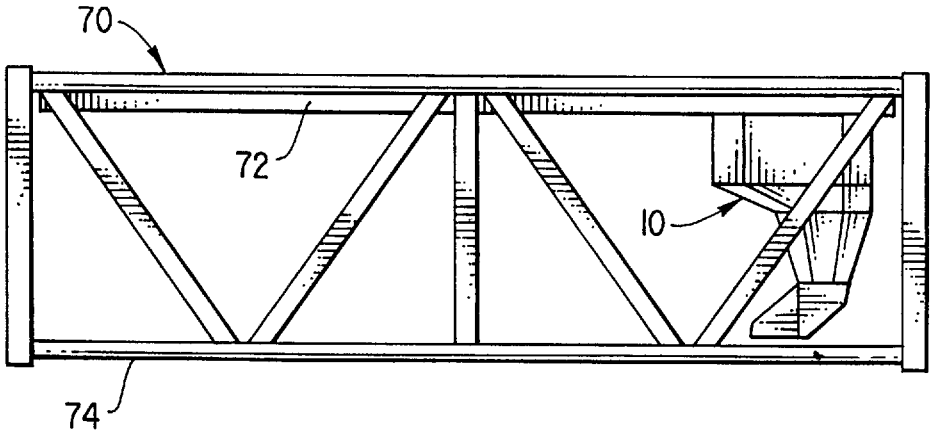
FIG. 9 is a diagrammatic elevational view of the theatrical light of the present invention shown mounted to a truss where the truss is in a closed, protective position ready for transport.

Referring now to FIGS. 8 and 9, the compact light 10 is shown attached to a compact truss 70 by a suitable means such as nuts and bolts. In the FIG. 8 view, the truss is shown in its raised position, as it would be above a stage, held by two cables 78 and 80. The base 72 of the truss has been lowered relative to its two side rails 74, 76, so as to expose the light 10 for operational use. Reference is made to U.S. Pat. No. 5,237,792, which described the compact truss in detail and is incorporated herein by reference. As explained there, the base 72 moves vertically relative to the side rails. The storage and transportation mode of the truss is shown in FIG. 9. There, the base 72 has been moved upwardly relative to the side rails. This allows the side rails to offer protection for the light. Rather than remove the light from the truss for shipment to a new venue, the light remains attached. In this way, the light is protected while it is stored or while in transit and, thus, time and labor are saved when compared to the practice of removing the light for transport or storage.

The combination of the light and truss makes for an exceedingly efficient lighting system for use by travelling performers who move from venue to venue after one or a few performances. The truss-light combination offers a structure which may be quickly assembled, disassembled and transported.

The fully enclosed housing, especially the two parts of the turret make for a very robust light which is self supporting. Hence, when the truss is transported, often standing on end in a truck trailer, the light is both protected by the truss and self protected by its own construction.

The method for forming the compact theatrical light 10 comprises the steps of forming an optical path, altering that path by a reflection of about 90 degrees by the first mirror 28, altering the path a second time by a reflection of about 90 degrees by the second mirror 32, altering the path yet again by a reflection of 90 degrees by the third mirror 38, and finally, altering the path for a fourth time by a 90 degree reflection by the fourth mirror 46. The method includes placing the gobo apparatus 34, the color/dowser/diffusion system 40 and the lenses 39, 41, 42 and 43 in the path between the second and the third mirrors. Placement of the rotatable mirrors 38 and 46 complete the reflections of the optical path. The mirrors and other elements are placed within a housing and the housing may be attached to a truss.

We claim:

1. A compact theatrical light comprising:

a housing;

a light source mounted in said housing for initiating a light beam in a specific direction;

a first mirror mounted in said housing for receiving said light beam from said light source and for altering the direction of said beam by approximately 90 degrees;

a second mirror mounted to said housing for receiving said beam from said first mirror, and for again altering the direction of said beam by approximately 90 degrees;

a third mirror mounted to said housing for receiving said beam from said second mirror and for again altering the direction of said beam by approximately 90 degrees;

a fourth mirror mounted to said housing for receiving said beam from said third mirror and for altering for the fourth time the direction of said beam by approximately 90 degrees, whereby said light beam defines an optical path;

a gobo mounted to said housing and positioned between said second and third mirrors for shaping the light beam in the optical path;

an element mounted to said housing and positioned between said second and said third mirrors for colorizing the light beam in the optical path;

a lens system mounted to said housing and positioned between said second and said third mirrors for focusing the light beam in the optical path; and said third and said fourth mirrors are each rotatable through 360 degrees.

2. A light as claimed in claim 1 wherein:

said light source and said first mirror are approximately 14 inches apart; and said first mirror and said second mirror are approximately 2.5 inches apart.

3. A light as claimed in claim 1 wherein:

said second mirror and said third mirror are approximately 23 inches apart.

4. A light as claimed in claim 3 wherein:

said light source and said first mirror are approximately 14 inches apart; and said first mirror and said second mirror are approximately 2.5 inches apart.

5. A light as claimed in claim 1 including:

a lens system mounted to said housing;

said lens system comprises a first movable lens mounted to said housing for allowing fine focus adjustment of said light beam;

a second fixed lens mounted to said housing;

a third movable zoom lens mounted to said housing; and a fourth fixed output lens mounted to said housing.

6. A light as claimed in claim 1 wherein:

said housing includes a base section, a transitional section connected to said base section, a projecting section connected to said transitional section and a turret section connected to said projecting section.

7. A light as claimed in claim 6 wherein:

said base section has a generally right octagonal prism shape.

8. A light as claimed in claim 7 wherein:

said transitional section has a generally oblique prism shape.

9. A light as claimed in claim 8 wherein:

said projecting section has a generally right octagonal truncated pyramid shape.

10. A light as claimed in claim 1 wherein:

said optical path includes a first portion between said light source and said first mirror, a second portion between said first and said second mirrors, a third portion between said second and said third mirrors, a fourth portion between said third and said fourth mirrors, and a fifth portion beyond said fourth mirror;

said first and said second portions form generally a plane; and said third portion is generally perpendicular to said plane.

11. A light as claimed in claim 1 wherein:

said light source is a xenon lamp; and including:

an elliptical reflector positioned about said lamp; and a spherical reflector positioned about said lamp.

12. A light as claimed in claim 1 wherein:

said light is attached to a truss.

13. A light as claimed in claim 12 wherein:

said light fits within a space no larger than 21×20×34 inches.

14. A light system comprising:

a housing;

a light source mounted in said housing for initiating a light beam in a specific direction;

a first mirror mounted in said housing for receiving said light beam from said light source and for altering the direction of said beam by approximately 90 degrees;

a second mirror mounted to said housing for receiving said beam from said first mirror and for again altering the direction of said beam by approximately 90 degrees;

a third mirror mounted to said housing for receiving said beam from said second mirror and for again altering the direction of said beam by approximately 90 degrees;

a fourth mirror mounted to said housing for receiving said beam from said third mirror and for altering for the fourth time the direction of said beam by approximately 90 degrees whereby said light beam defines an optical path;

a truss, said truss including a base and side rails;

said base is vertically adjustable relative to side rails;

said housing is connected to said base; and means for connecting said housing to said truss.

15. A method for forming a compact theatrical light comprising the steps of:

forming an optical path;

altering said optical path by about 90 degrees;

altering said optical path by about 90 degrees again from a plane formed by the first disposition of said optical path and the disposition of said optical path after the first altering step;

placing a gobo in the optical path after the second altering step;

placing a color chanter in the optical path after the second altering step;

placing a lens in the optical path after the second altering step;

placing a first rotatable mirror in the optical path whereby said optical path is altered a third time; and placing a second rotatable mirror in the optical path whereby said optical path is altered a fourth time.

16. A method as claimed in claim 15 including the steps of:

providing a housing for receiving said gobo, color changer, lens, and mirrors;

dividing said housing into sections;

placing said first and second mirrors in a base section of said housing;

placing said lens and color changer into transitional and projecting sections of said housing; and placing said rotatable mirrors in a turret section of said housing.

* * * * *